United States Patent [19]

Sakuma et al.

[11] Patent Number: 4,505,144

[45] Date of Patent: Mar. 19, 1985

[54] APPARATUS FOR SIMULTANEOUS BOTH-END SHAPING OF WORKPIECE

[75] Inventors: Kazuyoshi Sakuma, Hidakamachi; Tetsuo Nihei, Ooimachi; Toshio Maki, Kamifukuoka, all of Japan

[73] Assignee: Honda Giken Kogyo Kabushiki Kaisha, Tokyo, Japan

[21] Appl. No.: 467,505

[22] Filed: Feb. 18, 1983

[51] Int. Cl.[3] ..... B21D 22/00

[52] U.S. Cl. ..... 72/345; 72/356; 72/361; 72/405

[58] Field of Search ..... 72/344, 354, 356, 405, 72/361, 472, 476, 345

[56] References Cited

U.S. PATENT DOCUMENTS

| | | | |
|---|---|---|---|
| 3,188,849 | 6/1965 | Wisebaker et al. | 72/356 X |
| 3,588,933 | 6/1971 | Shinopulous | 72/361 |
| 3,783,670 | 1/1974 | Nickrawietz | 72/405 |
| 3,797,429 | 3/1974 | Wolfe | 72/344 |

*Primary Examiner*—Leon Gilden

*Attorney, Agent, or Firm*—Polster, Polster and Lucchesi

[57] ABSTRACT

An apparatus for working both ends of a workpiece at a time. The workpiece, typically in the form of a bar or a tube, is successively shaped by pre-shaping die means, shaping die means and finish-shaping die means, each of which comprises a pair of dies for simultaneously working both ends of the workpiece to a predetermined configuration. The dies in each pair are movable toward and away from the both ends of the workpiece, respectively, in accordance with the operation of a pair of hydraulic devices. A pair of knockout rods respectively slidably received in cylinders of the hydraulic devices cooperate to support the workpiece while the latter is progressively shaped. One of the knockout rods is fixed to one of the dies while the other knockout rod is held afloat relative to the other die by a hydraulic device, so that the workpiece is allowed to stretch to a full available length only at one end thereof on the afloat knockout rod side.

9 Claims, 7 Drawing Figures

APPARATUS FOR SIMULTANEOUS BOTH-END SHAPING OF WORKPIECE

BACKGROUND OF THE INVENTION

1. Field of the Invention

The present invention relates to an apparatus for swaging or otherwise shaping both ends of an elongate workpiece simultaneously. The elongate workpiece applicable to the present invention may be in the form of a bar or a tube, for example.

2. Description of the Prior Art

Various apparatuses have heretofore been proposed to shape end portions of workpieces such as bars or tubes, as disclosed in Japanese Patent Publication No. 47-33430. A problem has existed in these prior art apparatuses in that the ends of a workpiece cannot be shaped but only on a one at a time basis and this consumes a prohibitive time. Another problem is that the workpiece is allowed to stretch at both ends thereof while being shaped, resulting in inaccuracy in the lengths of products and, therefore, a substantial time and labor for trimming the products after the shaping operation. Additionally, the prior art apparatuses generate an objectionable level of noise during operation.

SUMMARY OF THE INVENTION

It is therefore an object of the present invention to eliminate the drawbacks inherent in the prior art shaping apparatuses as described above.

It is another object of the present invention to provide a shaping apparatus which is capable of shaping both ends of a workpiece at a time.

It is another object of the present invention to provide a shaping apparatus which shapes both ends of a workpiece to a remarkably high accuracy.

An apparatus embodying the present invention simultaneously shapes both ends of a workpiece which may typically be a bar or a tube. The apparatus comprises a pair of die means for shaping both ends of the workpiece to a predetermined configuration, a pair of drive means for driving the die means for reciprocation toward and away from the both ends of the workpiece, respectively, and a pair of support means for supporting the workpiece fixed in place during a shaping operation.

In accordance with the present invention, an apparatus for machining both ends of a workpiece at a time successively shapes a workpiece by means of pre-shaping die means, shaping die means and finish-shaping die means, each of which comprises a pair of dies for simultaneously working both ends of the workpiece to a predetermined configuration. The dies in each pair are movable toward and away from the both ends of the workpiece, respectively, in accordance with the operation of a pair of hydraulic devices. A pair of knockout rods respectively slidably received cylinders of the hydraulic devices cooperate to support the workpiece while the latter is progressively shaped. One of the knockout rods is fixed to one of the dies while the other knockout rod is held afloat relative to the other die by a hydraulic device, so that the workpiece is allowed to stretch to a full avvailable length only at one end thereof at the afloat knockout rod side.

BRIEF DESCRIPTION OF THE DRAWINGS

The objects and features of the invention will become more apparent from a consideration of the following detailed description taken in conjunction with the accompanying drawings in which.

DESCRIPTION OF THE PREFERRED EMBODIMENT

Figure 1:
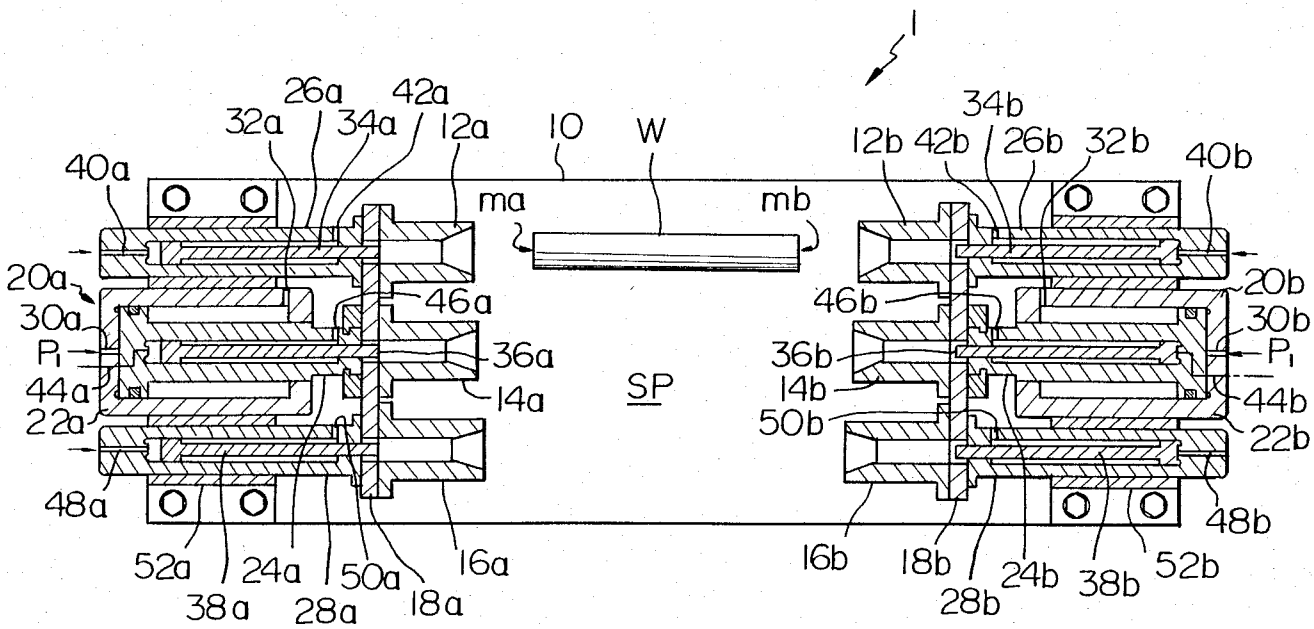
FIG. 1 is a sectional plan view of a shaping apparatus embodying the present invention, taken along line II—II of FIG. 2.
Figure 2:
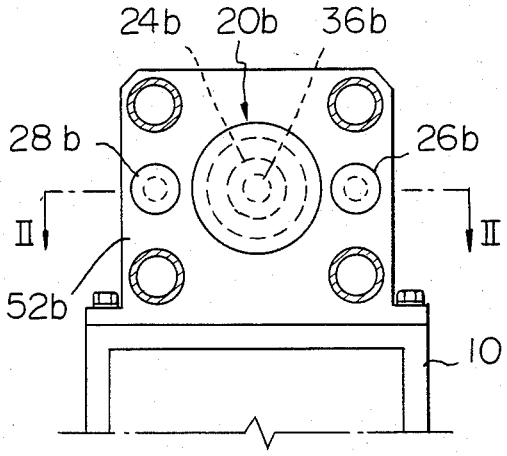
FIG. 2 is a side elevation of the apparatus shown in FIG. 1.

Referring to FIG. 1 of the drawings, a shaping apparatus embodying the present invention is shown and generally designated by the reference numeral 1. The shaper 1 comprises a generally flat and rectangular base or bed 10 adapted to support a bar or like workpiece W in a predetermined set position SP which is defined substantially at the intermediate between opposite lengthwise ends thereof. Workpieces W will be supplied intermittently to the set position SP on the base 10 as by a conveyor or a manipulator (not shown). Mounted on the base 10 at opposite sides of the set position SP are a first pair of dies 12*a* and 12*b* for preliminary shaping, a second pair of dies 14*a* and 14*b* for shaping and a third pairs of dies 16*a* and 16*b* for finish shaping. These die pairs are adapted for sequential transfer machining of the workpiece W.

In detail, the dies 12*a*, 14*a* and 16*a* are integrally supported by a base plate 18*a* and the dies 12*b*, 14*b* and 16*b* by a base plate 18*b*. The base plate 18*a* is fixed to the innermost ends of cylinders 24*a*, 26*a* and 28*a*. The cylinder 24*a* is slidably received in a main hydraulic cylinder (outer cylinder) 22*a* of a hydraulically operated device 20*a* which is located to the left of the set position SP in FIG. 1, the cylinder 24*a* serving as a piston rod in the piston and cylinder sense. Likewise, the base plate 18*b* is fixed to the innermost ends of cylinders 24*b*, 26*b* and 28*b* which oppose the cylinders 24*a*, 26*a* and 28*a*, respectively. The cylinder 24*b* is slidably received in a main hydraulic cylinder (outer cylinder) 22*b* of a second hydraulically operated device 20*b* which is located to the right of the set position SP, thus serving as a piston rod in the same sense as the cylinder 24*a*. With this construction, each base plate 18*a* or 18*b* is movable toward and away from the set position SP in accordance with the pressure of hydraulic fluid selectively communicated to passageways 30*a* and 32*a* or 30*b* and 32*b*, which are formed through the outer cylinder 22*a* or 22*b*. Knockout rods 34*a*, 36*a* and 38*a* are respectively received in the dies 12*a*, 14*a* and 16*a* to be slidable along the axis of their associated dies. Hydraulic fluid under pressure is selectively communicated to passageways 40*a* and 42*a* formed through the cylinder 26*a*, to passageways 44*a* and 46*a* formed through the cylinder 24*a*, and further to passageways 48*a* and 50*a* formed through the cylinder 28*a*. The hydraulic fluid under pressure is also communicatable to passageways 40*b* and 42*b* formed through the cylinder 26*b*, to passageways 44*b* and 46*b* formed through the cylinder 24*b*, and further to passageways 48*b* and 50*b* formed through the cylinder 28*b*, thereby causing into strokes knockout rods 34*b*, 36*b* and 38*b* which are respectively slidable within the dies 12*b*, 14*b* and 16*b*.

All the knockout rods 34*b*, 36*b* and 38*b* to the right of the set position SP have their rear ends held in constant engagement with the bottoms of the cylinders 26b, 24b and 28b, respectively, except for knockout operations. Meanwhile, all the knockout rods 34a, 36a and 38a to the left of the set position SP are kept movably afloat within their associated cylinders by a predetermined level of back pressure which is supplied by a hydraulic device (not shown) to their rear ends, even when they are out of knockout operations.

A frame member 52a is bolted or otherwise fixed to the bed 10 to firmly support the hydraulic device 20a while movably supporting the cylinders 26a, 24a and 28a. Likewise, a frame member 52b is mounted on the base 10 to rigidly support the hydraulic device 20b while movably supporting the cylinders 26b, 24b and 28b.

Figure 3:
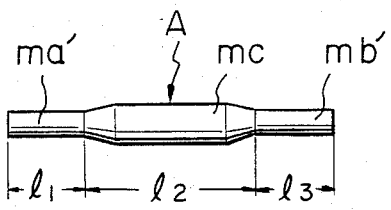
FIG. 3 is a front view of a workpiece produced by the apparatus of the present invention.
Figure 4:
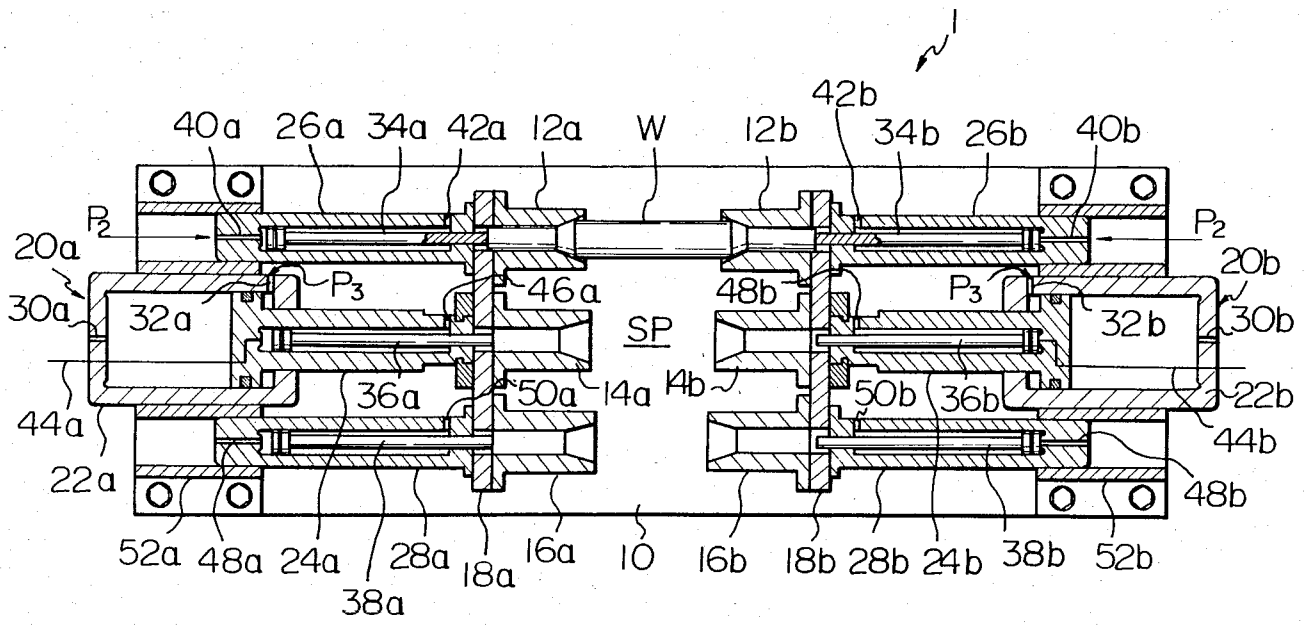
FIGS. 4–7 are views similar to FIG. 1 but showing the apparatus in sequential stages of shaping operation.
Figure 5:
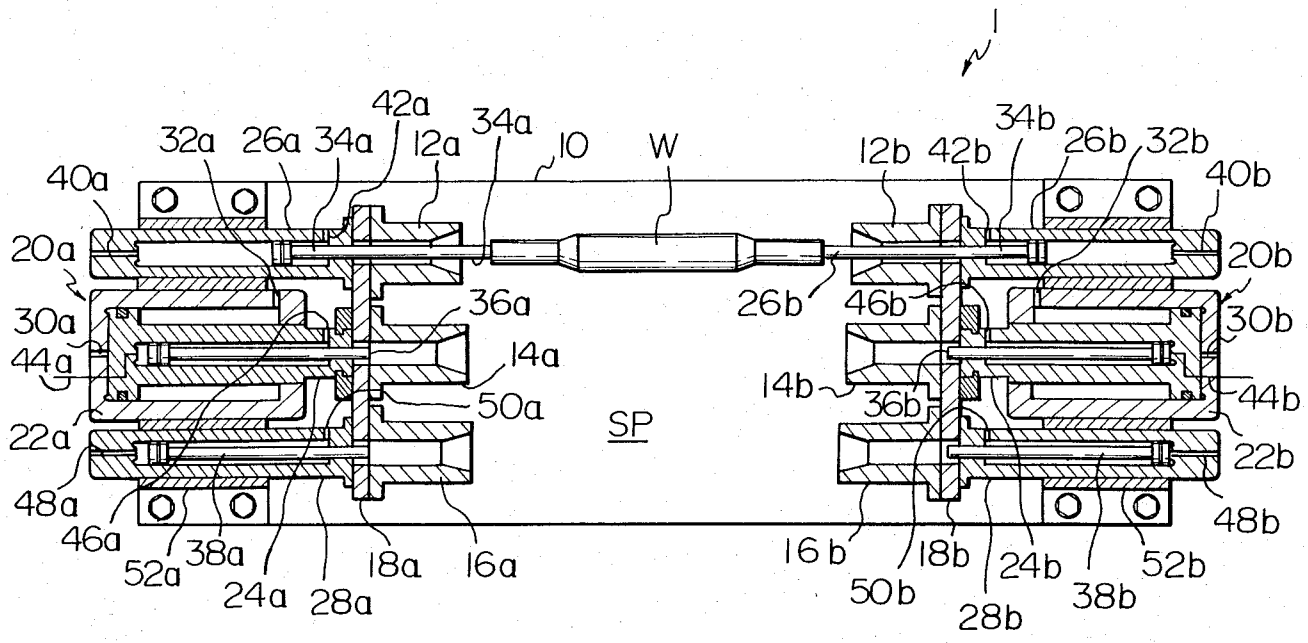
Figure 6:
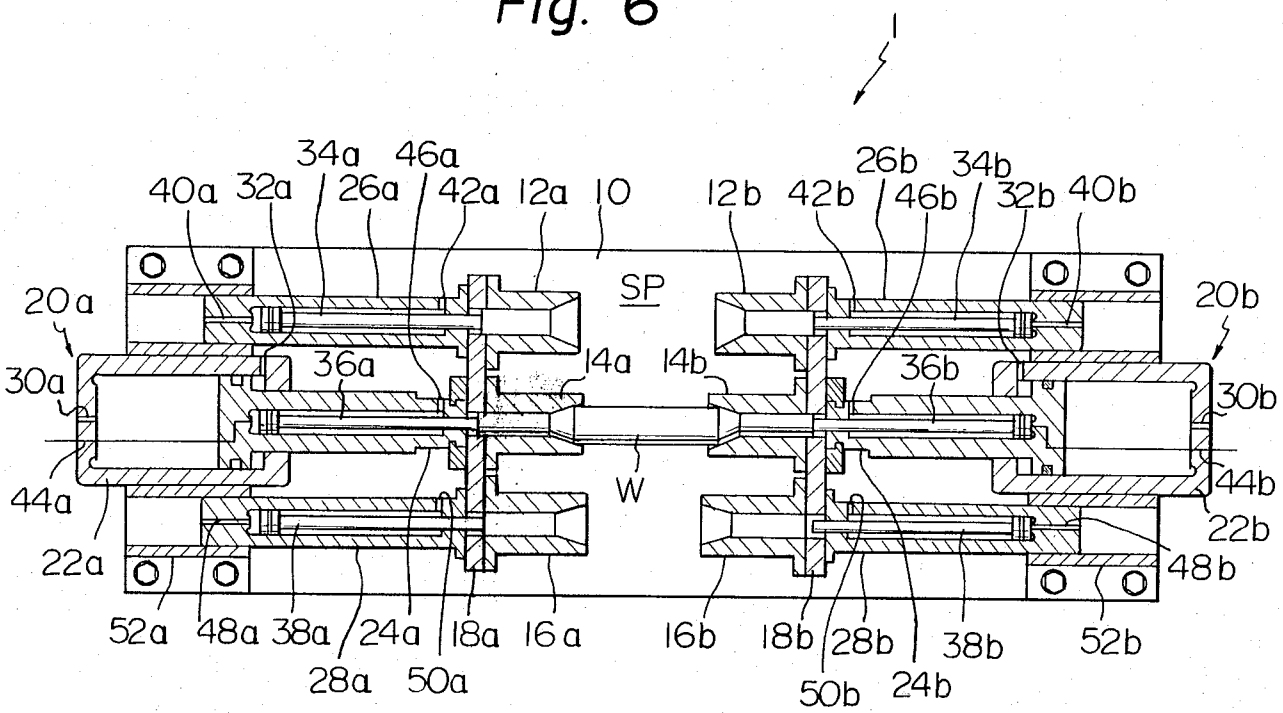

The die pairs 12a, 12b, 14a, 14b and 16a, 16b are configured to successively machine the workpiece W to the configuration illustrated in FIG. 3. As shown, the finished workpiece or product A is made up of an intermediate section mc, tapered sections extending from opposite ends of the intermediate section away from each other, and opposite end sections ma' and mb' smaller in diameter than the intermediate section mc and at which the tapered sections respectively terminate.

In operation, the workpiece W is located in a position which corresponds to the pre-shaping die pair 12a, 12b. As a fluid pressure $P_1$ is fed to the chambers at the backs of the main cylinders 22a and 22b of the hydraulic devices 20a and 20b each via the passageway 30a or 30b, all the dies 12a, 14a, 16a and 12b, 14b, 16b stroke toward the workpiece W at the same time. The dies 12a and 12b firmly grip and shape the opposite ends of the workpiece W. Thereafter, a fluid pressure $P_2$ is communicated to the chambers at the backs of the cylinders 26a and 26b each via the passageway 40a or 40b as indicated by arrows, while a fluid pressure $P_3$ is communicated to the chambers at the fronts of the main cylinders 22a and 22b each via the passageway 32a or 32b as indicated by arrows. Then, all the dies 12a, 14a, 16a and 12b, 14b and 16b are caused to stroke away from the workpiece W so that the pre-shaped workpiece W becomes clear of the dies 12a and 12b.

A transfer mechanism (not shown) is activated to advance the pre-shaped workpiece W simultaneously with the subsequent retraction of the knockout rods 34a and 34b, to the next shaping position where the coactive dies 14a and 14b face each other.

The workpiece W shaped by the dies 14a and 14b is shifted farther to a position where the finishing dies 16a and 16b are located. The dies 16a and 16b shape the workpiece W to the desired configuration shown in FIG. 7.

Figure 7:
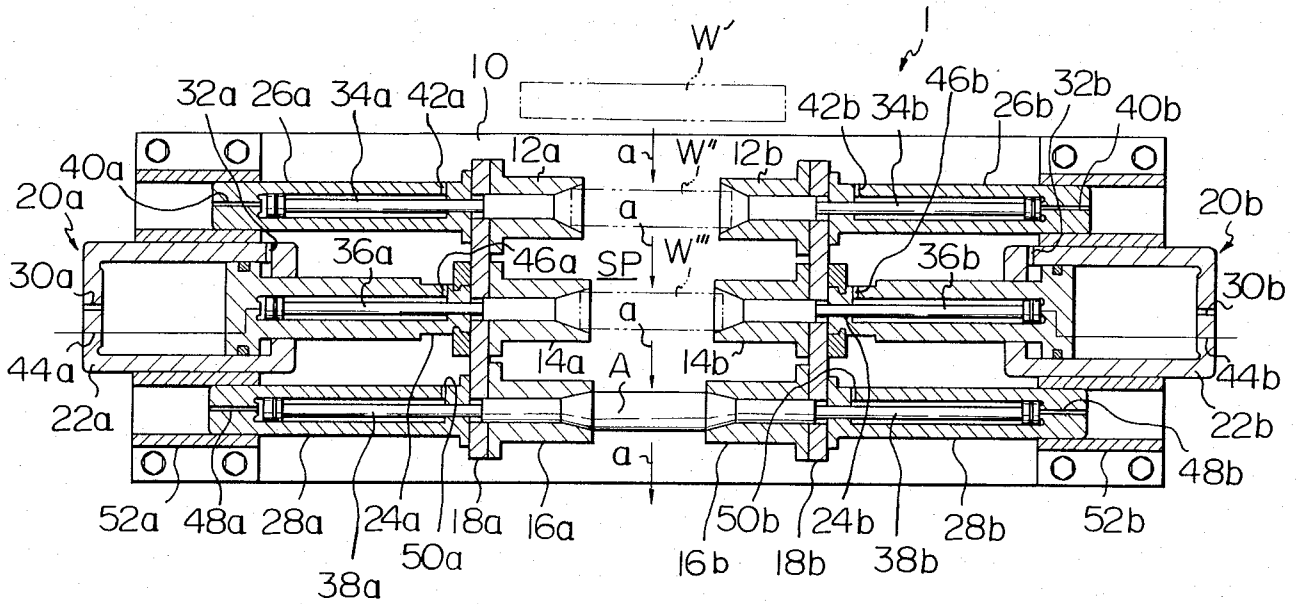

While the apparatus of the present invention has been shown and described as progressively feeding a single workpiece W from one work station to another on the bed 10, it will be understood that in practice a train of workpieces W', W'' and W''' are concurrently indexed on the bed 10 as indicated by an arrow a in FIG. 7.

In summary, it will be seen that the present invention provides an apparatus which shapes both ends of a workpiece at the same time and thereby remarkably improves the shaping efficiency over the conventional apparatuses which works only one end of the workpiece at a time.

While the coactive dies 12a and 12b (14a and 14b or 16a and 16b) shape opposite ends of the workpiece W, they exert a same magnitude of pressure which causes the workpiece W to deform and stretch within the dies. In this instance, because one end of the knockout rod 34b (36b or 38b) is fixedly located to face the bottom of the die 12b (16b or 18b), the corresponding end of the workpiece W is prevented from stretching beyond the range delimited by the one end of the knockout rod 34b. The workpiece W, therefore, lengthens itself only toward the other die 12a (14a or 16a) into abutment against the knockout rod 34a (36a or 38a). As will be recalled, the knockout rod 34a is held movably afloat by the back pressure applied thereto and, accordingly, yields to the deformation of the workpiece W.

Thus, the intermediate larger diameter section mc (inclusive of the opposite tapered sections) and one mb' of the end sections of the product A (see FIG. 3) are constrantly machined to their predetermined lengths $l_2$ and $l_3$, the dimentional inaccuracy concentrating in the length $l_1$ of the other end section ma'. It will suffice, therefore, to trim the end section ma' with reference to the length $l_3$ of the end section mb' after the workpiece W has been shaped up. This substantially halves the time and labor heretofore consumed in trimming both ends of a workpiece.

What is claimed is:

1. An apparatus for simultaneously shaping both ends of an elongate workpiece comprising:

a pair of die means for shaping both ends of the workpiece to a predetermined configuration;

a pair of drive means each for driving respective ones of said die means for reciprocation toward and away from an associated one of both ends of the workpiece;

a pair of support means each operably associated with a respective one of said die means for supporting the workpiece fixed in place with respect to said die means during a shaping operation;

means for fixing one of said support means against movement relative to its die means during the shaping operation; and pressuring means for pressuring one of the support means movably afloat relative to its die means yieldably to engage an elongated end of the workpiece during the shaping operation, whereby during the shaping operation, said pressuring means pressures the one support means against the associated one of the ends of the workpiece so as to bring the one support means movably afloat relative to one of the drive means; and during the shaping operation, the other of the support means is maintained fixed relative to the other of the drive means.

2. An apparatus in accordance with claim 1, in which the means for holding the support means afloat comprises a hydraulically operated device.

3. An apparatus in accordance with claim 1, in which the drive means comprise hydraulically operated devices.

4. An apparatus in accordance with claim 3, in which the hydraulically operated devices comprise hydraulic cylinders.

5. An apparatus in accordance with claim 4, in which the support means comprise knockout rods which are respectively slidably received in the hydraulic cylinders.

6. An apparatus in accordance with claim 1, in which each of the die means comprises a pre-shaping die, a shaping die and a finish-shaping dies.

7. An apparatus in accordance with claim 6, further comprising means for sequentially transferring the workpiece to the pre-shaping dies, shaping dies and finish-shaping dies in this order upon completion of shaping at the respective coactive dies.

8. An apparatus in accordance with claim 1, further comprising a bed on which the die means, the drive means and the support means are mounted.

9. An apparatus in accordance with claim 8, further comprising a frame member for supporting each of the drive means to be slidable relative to the bed.

* * * * *